United States Patent [19]

Postema

[11] Patent Number: 4,967,816

[45] Date of Patent: Nov. 6, 1990

[54] METHOD AND APPARATUS FOR FABRICATING ARCUATE WOODEN STRUCTURES

[76] Inventor: Leonard F. Postema, 4175 State Bridge Rd., Alpharetta, Ga. 30201

[21] Appl. No.: 459,143

[22] Filed: Dec. 29, 1989

[51] Int. Cl.[5] ..... B27G 1/00; B27H 1/00

[52] U.S. Cl. ..... 144/349; 144/262; 144/263; 144/266; 156/323

[58] Field of Search ..... 156/323, 443; 144/254, 144/256, 259, 262, 263, 264, 265, 266, 267, 349

[56] References Cited

U.S. PATENT DOCUMENTS

| | | | |
|---|---|---|---|
| 49,109 | 8/1865 | Hurm | 144/266 |
| 597,463 | 1/1898 | Gibson | 144/262 |
| 1,234,665 | 7/1917 | Hice | 144/263 |
| 2,350,915 | 6/1944 | Miller | 144/266 |
| 3,107,708 | 10/1963 | Savage | 144/266 |
| 4,886,568 | 12/1989 | Strozier | 144/266 |

*Primary Examiner*—W. Donald Bray
*Attorney, Agent, or Firm*—Thomas & Kerr

[57] ABSTRACT

An apparatus and method for fabricating arcuate structural members is disclosed, the apparatus including a frame structure (12) having a mandrel (26) mounted thereon, the mandrel having a variable radius. A resilient band (80) is provided for compressing the arcuate member against the mandrel. The method involves the steps of placing adhesive between individual lamina 91 and then progressively applying pressure against the laminae while they are in place adjacent the mandrel progressively from one end of the assembled laminae to the opposite end, utilizing the resilient band.

20 Claims, 4 Drawing Sheets

METHOD AND APPARATUS FOR FABRICATING ARCUATE WOODEN STRUCTURES

TECHNICAL FIELD

This invention relates to woodworking and particularly to the fabrication of arcuate wooden structures such as arched headers for doors and window jambs.

BACKGROUND OF THE INVENTION

Windows and doorways having arched headers have long been popular architectural additions to homes and buildings. Such windows and doorways typically include a wooden jamb that has spaced vertical members joined at their top ends by a curved or arched wooden header. Although the vertical members of such casings are easily fabricated, reliable methods of fabricating high quality arched wooden headers have long evaded woodworking craftsmen. In one method of crafting such headers, elongated wooden blocks are mitered at their ends and secured together end to end to form the general shape of the arch. The curve is then cut with a band saw to form the arched header, which can then be machined if desired and secured to upper ends of the vertical jamb members. Headers fabricated in this traditional way have had several shortcomings. The butt joints between the blocks, for example, tend to separate over time due to changes of temperature and moisture-induced expansion and contraction of the adjacent blocks. Further, such headers generally are not suitable for staining because the skewed relative orientations of the wood grain of adjacent blocks usually is not considered visually attractive. Consequently these headers often are limited to use in door and window frames that are to be painted.

In a more recent method of fabricating arched headers, a plurality of thin wooden boards are stacked with glue applied between adjacent boards to define a laminate. The stacked boards are placed atop a convex form and an elongated metal band is positioned to extend along the top board and overlie the stack. The ends of the band are then drawn toward the ends of the convex form such that the boards are bent by the band toward engagement with the form. The forces applied by the band to the stacked boards are maintained until the adhesive has cured. This method has certain drawbacks. Bending wood strips into an arcuate form with pressure applied downwardly on each end results in having upward pressure applied to the center portion of the strips and little or no pressure applied intermediate the center portion and the ends. As a result, the individual strips are prone to cracking and are subject to a significant amount of surface friction and sliding motion between layers that interferes with proper compression. In addition, the relatively thick adhesive tends to become trapped between individual lamina in excessive amounts due to surface imperfections in the lamina, ripples formed in the laminae during bending or the uneven application of pressure. As a result, the product quality is uneven and the method is unreliable.

Another known method of forming arcuate pieces is a mass production operation in which hydraulic presses are used to form the arches. In this method, arcuate rams are forced into concave forms with the wood lamina trapped and compressed therebetween. This method is capable of producing large quantities of headers, for example, but is unsuitable for custom work in individual structures and necessitates the use of thin highly flexible lamina which detracts from the finished appearance and adds to the cost. Many of the problems inherent in prior art methods using steel bands are also present with the hydraulic press method.

Thus, a need exists in the art for an apparatus and method of forming arcuate structural members that avoids the disadvantages of the prior art while producing pieces of a quality superior to that of pieces produced by prior art methods. It is to the provision of such an apparatus and method that the present invention is primarily directed.

SUMMARY OF THE INVENTION

Briefly described, the present invention comprises a method and apparatus for producing arcuate structural members such as headers for doors and windows. According to the method, wooden boards or the like are formed in a stack with adhesive spread between the boards. The boards are then clamped together at one end adjacent one end of a convex form and a progressive compressive force is applied by a tool from the clamped end of the stack to the other end thereof to clamp the boards together about the convex form. The force applied by the tool to the stacked boards is first applied adjacent the clamped ends of the boards and the force is progressively moved about the convex form so as to gather the boards toward the form progressively. When the tool reaches the other end of the form the boards are firmly pressed together throughout their facing surfaces.

It is, therefore, one of the principal objects of the present invention to facilitate the fabrication of arched structural members by providing an apparatus and method for expediently and reliably shaping such members, utilizing a force that is progressively applied from one end of the structural member to the other so as to shape the structural member progressively.

Another object of the present invention is to provide an apparatus and method for forming arched structural members that use thicker lamina than prior art methods or devices for enhancing the appearance and reducing the cost of the members and which apparatus and method are adjustable for providing members in a plurality of arcuate shapes and sizes.

A further object of the present invention is to provide an apparatus for forming arcuate headers and the like with the apparatus being easy to build, operate and maintain and with the apparatus being durable for providing a long service life.

A still further object of the present invention is to provide a method of forming arched structural members in which the shapes and sizes into which the pieces are to be formed are easily varied by adjusting the apparatus and with the method providing the ability to form the structural member with straight tangential terminal extensions for connection to the upper end portions of window or door jambs.

These and other objects are attained by the present invention which relates to an apparatus and method for forming arcuate structural members such as a laminated wooden arch over a door or window. The apparatus is constructed so as to form arches of various sizes within the limits of standard building materials, and of a plurality of arcuate shapes, from a semicircle to an elliptical shape.

The method of the present invention involves the steps of applying an adhesive between the lamina, clamping one end of the stack of lamina in a straight jawed vice, applying a force against the outer layer of the lamina toward a convex form and translating the force progressively from the clamped end of the lamina toward the free end of the lamina so as to shape the lamina about the convex form progressively. This sequence provides a thin, even coating of adhesive between the layers of material thus facilitating curing and assuring an attractive appearance.

Various additional objects and advantages of the present invention will become apparent from the following description, with reference to the accompanying drawings.

DETAILED DESCRIPTION OF THE PREFERRED EMBODIMENT

Figure 1:
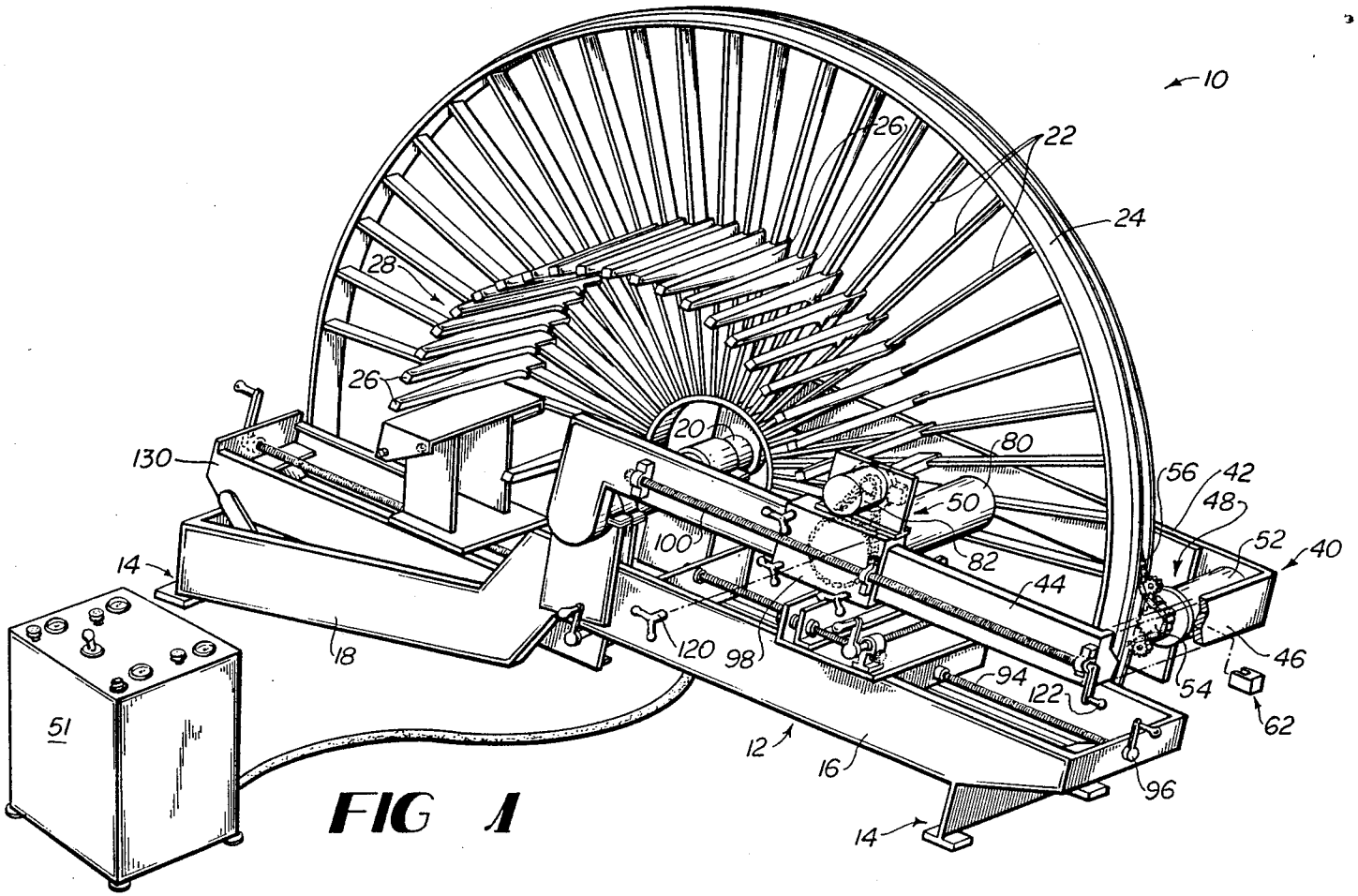
FIG. 1 is a perspective view of the present apparatus for forming arched structural members.
Figure 2:
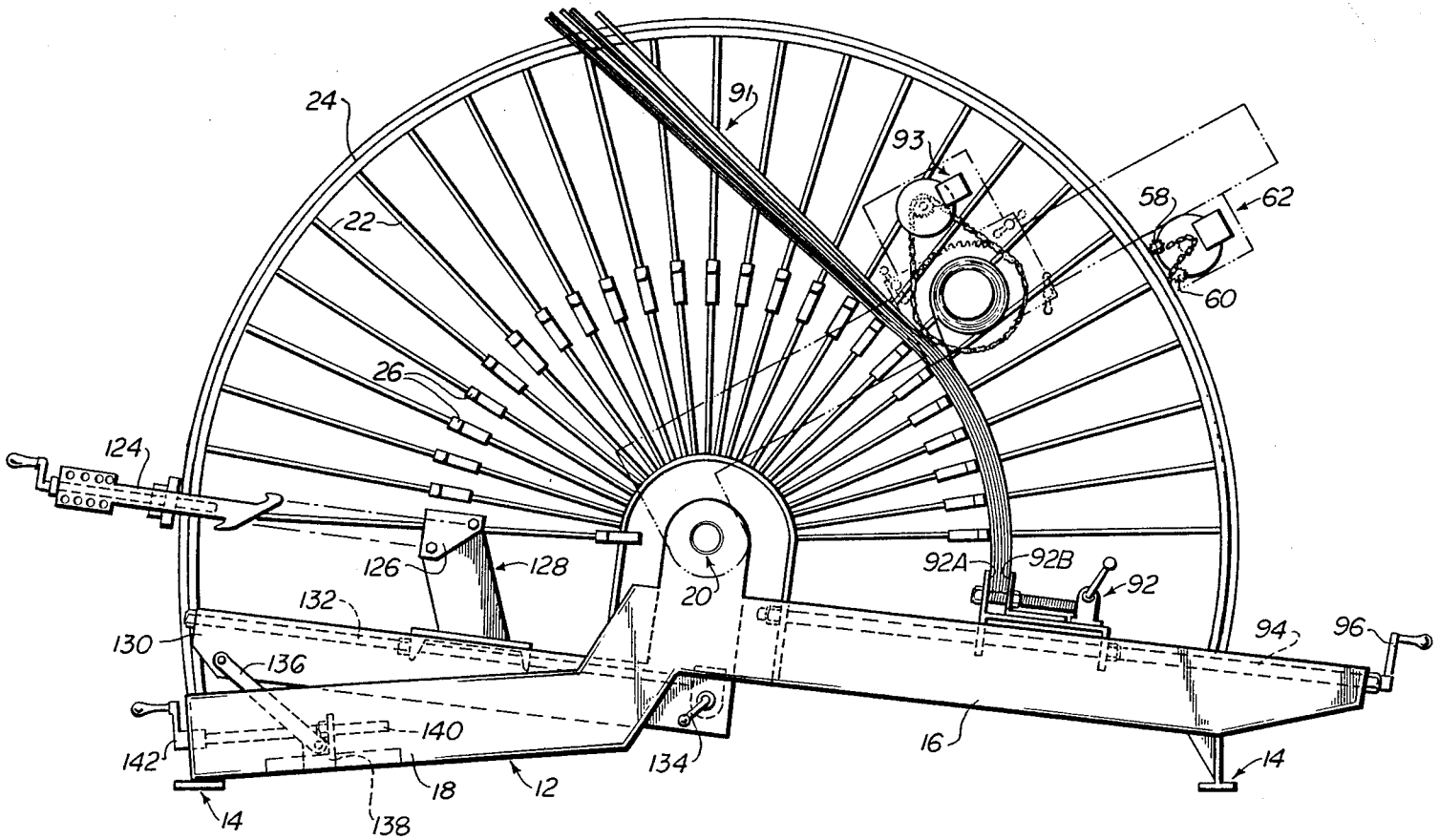
FIG. 2 is a side elevational view of the present apparatus.

Referring now more specifically to the drawings, and to FIG. 1 in particular, numeral 10 designates generally the apparatus for fabricating arcuate structural members. The apparatus is characterizd by a generally rectangular, horizontal main frame member 12 that has an offset configuration and is supported on the floor by downwardly extending feet 14. The offset configuration of the main frame allows overbending of work pieces, for reasons explained more fully hereinbelow. As can be seen in FIGS. 1 and 2, the main frame includes spaced long leg portions 16, spaced short leg portions 18, and a generally central transversely extending hub 20 adjacent to the intersections of the leg portions.

Figure 4:
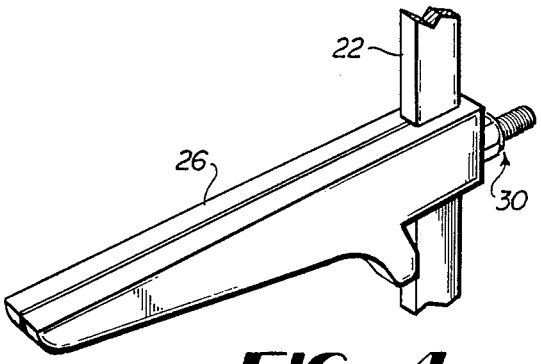
FIG. 4 is a perspective view of one of the support means for the stacked laminae.
Figure 5:
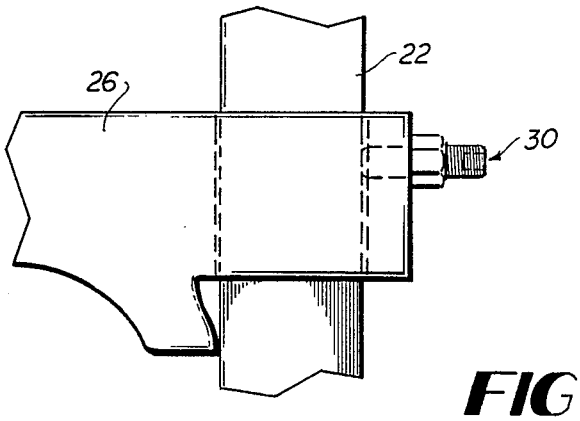
FIG. 5 is a partial, side elevational view of the support means shown in the preceding Fig.
Figure 6A:
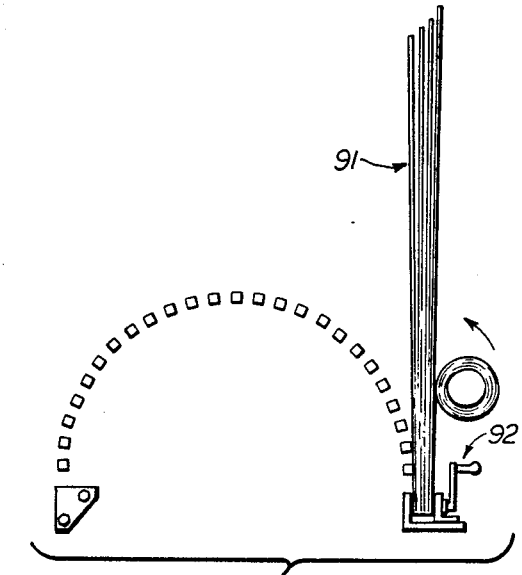
FIGS. 6A–6E illustrate the sequence of production utilizing the present method.
Figure 6B:
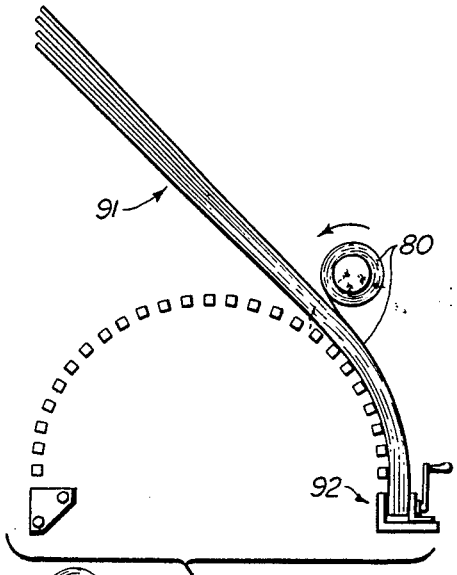
Figure 6C:
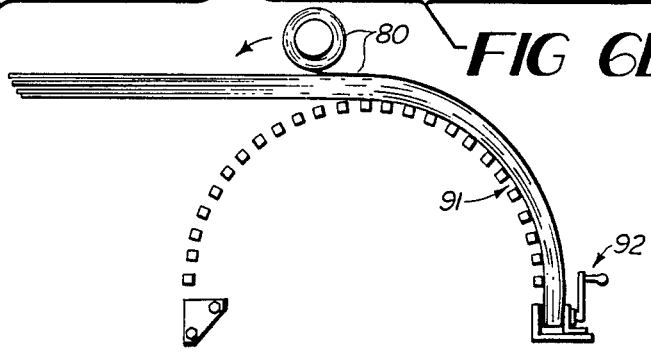
Figure 6D:
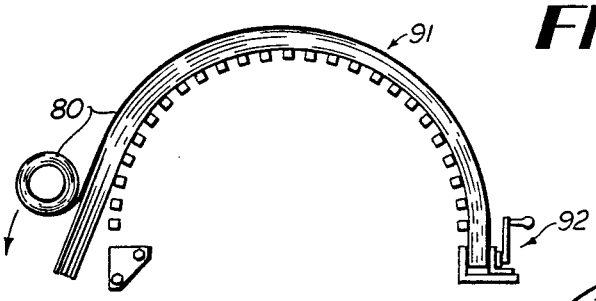
Figure 6E:
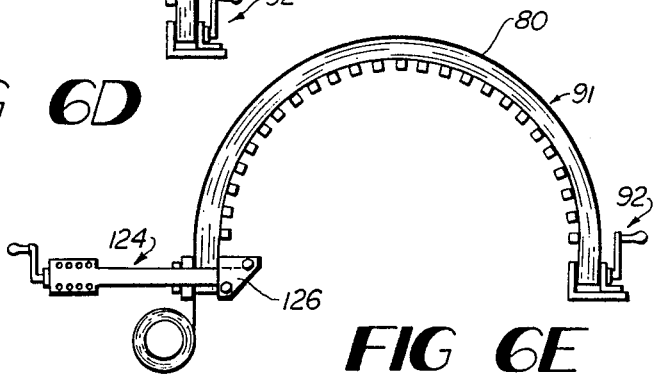

Secured about the hub 20 are the ends of a plurality of spokes 22 that extend radially outwardly from the hub in a fanned arrangement, with the spokes being secured at their opposite ends to an outer rim member 24. The outer rim is arcuate or semicircular in shape and is secured at its lower ends to the main frame as shown. Mounted on the spokes 22 are a plurality of laterally extending support arms 26, one for each spoke. The individual support arms together form a mandrel 28, around which laminae can be shaped. These arms 26 are adjustably secured on the spokes (FIGS. 4 and 5) and include adjustment screws 30 that can be used to adjust the angular orientations of the arms 26 relative to their respective spokes to compensate for the natural flexing of the spokes and arms under clamping pressure. Spring biased pressure pads (not shown) can also be disposed within holes in the arms 26 if desired and arranged to bear against the spokes 22 to help secure the arms in position on their respective spokes. The arms 26 are thus movable radially relative to the hub 20 on the spokes 22 to vary the dimensions of the mandrel according to the desired shape and size of the finished product.

Pivotally mounted on the central hub 20 is a generally U-shaped main arm assembly 40 comprising parallel right and left arm members 42 and 44 respectively, as shown in FIG. 1, and a connecting arm 46. The right and left arms have offset ends that are rotatably attached to the hub 20 with the arms extending generally radially outwardly from the hub past the outer rim 24 to embrace the spokes 22 and arms 26. The arm assembly is designed to pivot or rotate about the central hub 20 and thus travel from one side of the main frame across the top of the rim 24 to the other side of the main frame.

The main arm assembly 40 carries two motor assemblies, a drive motor assembly 48 which is fixed to the right arm member 42, and an auxiliary motor assembly 50 which is adjustably mounted on the left arm member 44. The drive motor assembly 48 includes a motor 52 with a driven gear 54 that engages a chain 56 or similar element disposed about the outer periphery of the rim 24. Spaced idler gears 58 and 60 are disposed on opposite sides of the drive gear and the chain 56 passes beneath the idler gears and around the driven gear to provide sufficient area of contact between the driven gear and chain and to keep the chain taut as the drive motor assembly moves the main arm about the hub 20. The drive motor assembly is also equipped with a holding means such as caliper brake assembly 62 that can be engaged to resist rotational movement of the arm assembly 40 about the hub 20. Conventional power means such as electric or hydraulic power is used to power the drive motor assembly and its brake assembly.

The auxiliary motor assembly 50 (FIG. 3) is configured to wind a flexible preferably stainless steel band 80 about a cylindrical drum 90. Specifically, the motor assembly 50 includes a motor 82 having a drive gear 84 that engages and drives an element such as chain 86. The chain in turn drives a gear 88 and consequently a drum 90, which is attached to the gear 88. As with the drive motor 52, the auxiliary motor 82 also has a holding means, such as a caliper brake assembly 93 that can be engaged to resist rotational movement of the drum 90. Power for the auxiliary motor and brake assemblies is furnished in a conventional manner as with the drive motor.

The use and operation of the motor assemblies can best be explained in describing the operation of the entire apparatus with reference to FIGS. 1, 2 and 6A–6E. Prior to operation, the desired size and shape of the finished arcuate structural member is selected which might, for example, be semicircular or elliptical. The arms 26 are then positioned on their respective spokes to define a mandrel of size and shape corresponding to that of the finished structural members. For this purpose, the spokes 22 can expediently be provided with indicia of measurement to assist the operator in accurately positioning the arms 26. An alternate embodiment contemplates a plurality of mandrels of fixed size and shape that can be easily substituted for each other on the apparatus and that could replace the spoke and arm design of the preferred embodiment.

With the desired mandrel shape and size thus established, the wood laminae 91 are assembled in a stacked configuration with a suitable adhesive applied between the individual lamina. A sheet of plastic to protect the support arms can be placed over the mandrel if desired whereupon one end of the gathered laminae is clamped by a suitable adjustable clamp means 92. The clamp 92 has confronting flat jaw surfaces 92A and 92B between which the lamina are captured and clamped. The clamp 92 can be adjusted as detailed below such that jaw surface 92A is aligned with the tangent of the arch formed by the mandrel 28. In this way, the end portions of the lamina are clamped together to form a straight terminal end portion of the finished structure that extends tangentially from the arched portion thereof. As mentioned above, this straight portion provides for a secure lap-joint type attachment of the arched header to the spaced vertical elements of a door jamb. Clamp 92 is axially adjustable on leg 16 by means of travel screw 94 and its associated adjuster or crank handle 96.

As noted hereinabove, motor assembly 50 is adjustably mounted on arm 44, the motor assembly being secured to an adjustable carriage means 98. Carriage 98 is operatively associated with a travel screw 100 which is secured parallel with arm 44. The carriage position is adjusted axially on arm 44 by loosening its holding screws 120 and then turning crank 122. The carriage can thus be adjusted such that the band 80 is disposed essentially flush with the outermost one of the clamped wood laminae whereupon the holding screws 120 are tightened to secure the carriage and motor assembly 50 in place.

Figure 3:
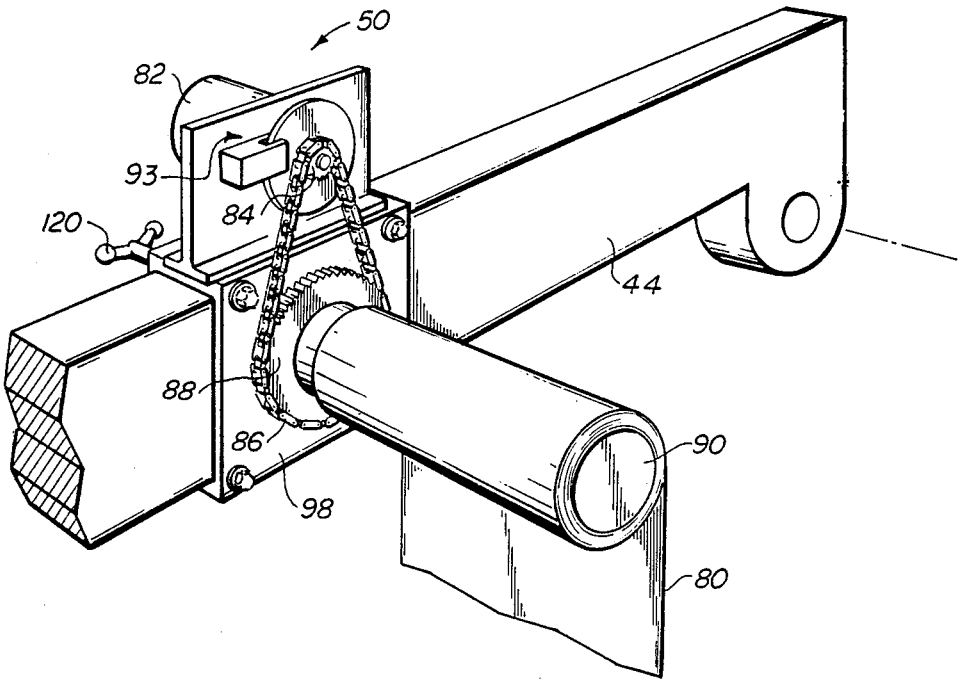
FIG. 3 is a partial, perspective view of the clamping band and roller therefor.

With the ends of the lamina clamped in clamp 92 and the drum assembly properly adjusted on the arm 44, the apparatus is then operated to compress the lamina progressively together against and around the mandrel 28. Specifically, the controls 51 are first appropriately manipulated to engage the calliper brake 93 of the auxiliary motor assembly 50. The brake pressure can be adjusted to provide the desired degree of resistance to rotation of the drum 90 as best illustrated in FIG. 3. With the brake thus set, the motor 52 can be actuated to rotate the main arm assembly 40 about the central hub 20 in a counterclockwise direction as seen in FIG. 1. As the arm assembly 40 rotates, the steel band 80 is pulled from about the drum 90 causing the drum to rotate against the resistive force of the caliper brake assembly 93. In this way, great tension is imparted to the band as it is progressively wrapped about the mandrel causing the lamina to be compressed tightly together between the mandrel and the band. Further, since the lamina are compressed progressively from one end toward the other in "pinch roller" fashion, individual boards of the laminate, once having engaged adjacent boards, are not required to shift to find their final relative positions.

The progressively applied pressure also ensures that the adhesive is spread evenly between adjacent lamina by progressively squeezing excess glue just ahead of the line of engagement of the lamina as they are pressed together to form a moving "glue front". The result is a tight strong bond that can hardly be detected making the finished structural member appear to be formed of a single unitary piece of wood. The structure can then be finish machined if desired and stained to provide an archway of exceptional precision and aesthetic appeal.

The operation continues, as illustrated in FIGS. 6A–6E, until the laminae are bent around the mandrel into the desired shape whereupon a terminal clamp 124 is tightened against the band, the laminae, and a block member 126, which provides an inner jaw surface for the terminal clamp. As with clamp 92, the inner jaw surface of the terminal clamp 124 is aligned with the tangent of the mandrel arc to provide a straight terminal portion of the finished member for lap-joint attachment to a door jamb. As shown in FIG. 2, the block member 126 is mounted on a carriage means 128, which is axially adjustable on a subframe member 130 by means of travel screw 132 and adjustment crank 134 to align the inner jaw surface with the mandrel arc. The axial adjustment is of course determined by the radius of the structural member being formed.

The circumferential position of the inner jaw surface block 126 relative to the first clamp 92 is adjustable by means of a subframe 130. The subframe 130 is rotatably attached to the central hub 20 and can be rotated thereabout by means of a lever arm 136 that is rotatably secured at one end to the subframe 130 and at its other end to movable bracket 138. Bracket 138 can be longitudinally positioned by means of a travel screw 140 that in turn can be rotated by a crank 142. As the crank is rotated, the responding bracket and lever arm cause the subframe 130 to pivot a few degrees about the central hub 20. The inner jaw surface is thus moved in an arc that is a continuation of the arc of the mandrel 28. Preferably, the jaw surface can be positioned as described within a range of 180 degrees to 190 degrees relative to the position of the clamp 92. This provides the capability to overbend an arcuate structural member by a few degrees to compensate for the natural tendency of the wood to spring back slightly when removed from the apparatus.

The just described procedure can also be reversed if desired or necessary to, for example, add an additional lamina. In reversing the procedure, the caliper brake 93 of the auxiliary motor assembly is released and the brake 62 of the drive motor assembly simultaneously engaged. The motor 82 can then be engaged to rewind a portion of the band 80 about the drum 90 causing the main arm assembly to pivot in a clockwise direction (FIG. 1) against the resistive force of the caliper brake assembly 62. In this way, the band can be removed from about the mandrel just far enough to insert the new lamina while constantly maintaining compressive force on the remaining portion of the lamina. With the new lamina in place, the process is again reversed to continue formation of the member as described.

Thus, as can be easily appreciated, the present invention allows the easy fabrication of arcuate structural members. Since the compression of the lamina is progressive the lamina, once having been stressed is captured and confined between the mandrel and the band such that lamina breakage often encountered with prior art methods is greatly reduced. Relatively thick lamina may therefore be used, eliminating a significant amount of ripping and planing to get easily bendable strips. Where prior art methods commonly require lamina of less than ⅛" thickness the present invention easily forms arcuate members from significantly thicker strips. In addition, the progressive clamping of the laminae by the band 80 squeezes the adhesive along a "front" which ensures even distribution of the adhesive between adjacent lamina. Upon curing of the adhesive, the arcuate member is unclamped and is ready for decorative machining or staining if desired and for installation.

Thus, while an embodiment of an apparatus and method of forming arcuate structural members and modifications thereof has been shown and described in detail herein, various additional changes and modifications may be made without departing from the scope of the present invention.

I claim:

1. An apparatus for producing arcuate structural members from individual wood lamina with adhesive means disposed between the lamina, said apparatus comprising a frame member having support means mounted on said frame member for receiving the laminae to be bent, a first clamp means for holding one end of said laminae adjacent an end of said support means, means for progressively applying and holding pressure on said laminae for bending said laminae around said support means, said pressure being applied from the clamped end of the laminae to the opposite end thereof.

2. An apparatus for producing arcuate structural members as defined in claim 1 in which said support means includes a mandrel having a plurality of radially adjustable arm members.

3. An apparatus for producing arcuate structural members as defined in claim 1 in which said apparatus includes an outer rim connected at the ends thereof to said frame member and having a plurality of spokes in spaced relationship secured thereto and which converge inwardly toward the center of said apparatus.

4. An apparatus for producing arcuate structural members as defined in claim 3 in which said support means includes a mandrel with a plurality of arm members mounted on said spokes and being axially adjustable thereon for varying the size and shape of said mandrel.

5. An apparatus for producing arcuate structural members as defined in claim 1 in which said means for progressively applying pressure comprises a flexible band disposed against the outermost one of said lamina, said band being stored on and dispensed from a drum.

6. An apparatus for producing arcuate structural members as defined in claim 5 in which said apparatus includes a second clamp means for holding said band and said opposite end of said laminae.

7. An apparatus for producing arcuate structural members as defined in claim 1 in which said apparatus includes a subframe member which is adjustable relative to said frame member with said subframe bearing a terminal block member defining a jaw face for receiving said opposite end of said laminae and in which said subframe member can be adjusted to locate said terminal block member in a preselected angular position relative to said first clamp means.

8. A method of forming an elongated wooden member into an arcuate shape comprising the steps of:

(a) providing at least one surface forming an arcuate mandrel having first and second ends;

(b) securing one end of the wooden member adjacent said first end of said mandrel;

(c) applying pressure to and maintaining the applied pressure on the wooden member progressively from the first end of the mandrel to the second end thereof to compress and hold the wooden member against the mandrel with the wooden member extending about the mandrel; and (d) securing the wooden member for a predetermined time in position about the mandrel.

9. The method of claim 8 wherein step (c) includes progressively wrapping a resilient band about the outermost surface of said wooden member for sandwiching the wood member between the mandrel and the band.

10. The method of claim 9 and further including the step of tensioning the resilient band while wrapping it about the mandrel.

11. An apparatus for fabricating an arched wooden structure comprising:

at least one surface arranged to form an arcuate mandrel having first and second ends;

first clamp means positioned adjacent the first end of said mandrel for securing an end of said wooden structure;

means for wrapping and securely holding the wooden structure about said mandrel progressively from said first end of said mandrel toward said second end thereof.

12. An apparatus as defined in claim 11 in which said means for wrapping and securing holding the wooden structure about the mandrel includes a resilient band mounted on and dispensed from a drum and a first brake assembly operatively associated with said drum to resist rotation thereof, said apparatus being configured to move said drum about said mandrel in a fist direction thereby dispensing said band and wrapping it about said mandrel with the wooden structure captured between said band and said mandrel.

13. The apparatus of claim 12 and further including motor means operatively coupled to rewind said band about said drum and thereby move the drum about the mandrel in a second direction opposite to said first direction to release a previously captured portion of the wooden structure and a second break assembly configured to be engaged to resist motion of the drum in said second direction.

14. An apparatus as defined in claim 11 in which said one or more surfaces comprises a mandrel having a variable radius.

15. An apparatus as defined in claim 14 in which said mandrel includes a plurality of individual spokes radiating outwardly from a generally central hub, each of said spokes having a support arm mounted thereon and being axially adjustable thereon for varying the size and shape of said mandrel.

16. An apparatus as defined in claim 12 in which said apparatus includes a main frame member for supporting said one or more surfaces and a subframe member which is adjustable relative to said frame member and which bears a terminal block member for receiving said wood structure and in which said subframe member can be adjusted to locate said terminal block member in a preselected angular position relative to said first clamp means.

17. A method of forming an elongated wooden member or the like into an arcuate shape comprising the steps of:

gathering a group of overlying boards or the like at one common end of the boards;

applying a force to one side of the gathered end of the group of boards to urge the gathered end of the group of boards toward a convex support means, progressively moving and maintaining the applied force along the length of the gathered boards in a path extending about a convex surface of the convex support means to urge and secure the group of boards progressively into a secured aligned, arcuate relationship about the support means.

18. The method of claim 17 and further including the step of applying a coating adhesive to the facing surface of the boards before the step of applying force to the group of boards, and wherein the step of progressively moving the applied force along the length of the gathered boards further comprises squeezing the coating of adhesive along the length of the boards as the applied force moves along the length of the gathered boards.

19. The method of claim 18 and further including the step of slipping the boards with respect to each other as the applied force is progressively moved along the length of the gathered boards.

20. A method of producing arcuate structural members such as arches for doors and windows, comprising:

spreading adhesive on the surfaces of a plurality of boards or the like;

gathering the plurality of boards in an aligned stack with adhesive positioned between each board;

clamping one common end of the boards adjacent one end of a convex form, applying a force against the gathered boards at a position adjacent the clamped ends of the boards to urge the boards against the convex form; and progressively moving and maintaining the applied force about the convex form so as to gather and hold the boards progressively toward and against the form.

* * * * *